US007196472B2

(12) United States Patent
Hasegawa et al.

(10) Patent No.: US 7,196,472 B2
(45) **Date of Patent: *Mar. 27, 2007**

(54) PLASMA DISPLAY PANEL, ITS MANUFACTURING METHOD, AND ITS PROTECTIVE LAYER MATERIAL

(75) Inventors: Kazuyuki Hasegawa, Settsu (JP); Yoshinao Oe, Kyoto (JP); Hiroyuki Kado, Ibaraki (JP); Kaname Mizokami, Osaka (JP); Hirokazu Nakaue, Daito (JP)

(73) Assignee: Matsushita Electric Industrial Co., Ltd. (JP)

( * ) Notice: Subject to any disclaimer, the term of this patent is extended or adjusted under 35 U.S.C. 154(b) by 191 days.

This patent is subject to a terminal disclaimer.

(21) Appl. No.: 10/517,782

(22) PCT Filed: Mar. 3, 2004

(86) PCT No.: PCT/JP2004/002597

§ 371 (c)(1),
(2), (4) Date: Dec. 10, 2004

(87) PCT Pub. No.: WO2004/079769

PCT Pub. Date: Sep. 16, 2004

(65) Prior Publication Data

US 2005/0253519 A1 Nov. 17, 2005

(30) Foreign Application Priority Data

Mar. 3, 2003 (JP) ..... 2003-055548
May 19, 2003 (JP) ..... 2003-140165

(51) Int. Cl.
*H01J 17/49* (2006.01)
*H01J 9/00* (2006.01)
*H01J 9/24* (2006.01)

(52) U.S. Cl. ..... 313/587; 313/582; 313/586; 445/24

(58) Field of Classification Search ..... 313/582–587; 445/24

See application file for complete search history.

(56) References Cited

U.S. PATENT DOCUMENTS 6,171,438 B1 * 1/2001 Masuda et al. ..... 156/345.27

(Continued)

FOREIGN PATENT DOCUMENTS

JP 6-316671 11/1994
JP 10-334809 12/1998
JP 11339665 A * 12/1999

(Continued)

OTHER PUBLICATIONS

Computer translation of Applicant cited Hidaka JP PUB 2001-110321.*

*Primary Examiner*—Mariceli Santiago
*Assistant Examiner*—Peter Macchiarolo
(74) *Attorney, Agent, or Firm*—Rossi, Kimms & McDowell LLP

(57) ABSTRACT

The present invention provides a plasma display panel that has a fast response in discharge generation to voltage application owing to a short discharge delay time, and at the same time suppresses the change in the discharge delay time to temperature. In the plasma display panel, dielectric layer (9) is formed so that it covers scanning electrode (5) and sustain electrode (6) formed on front substrate (4), and protective layer (10) is formed on dielectric layer (9), where protective layer (10) includes carbon and silicon, and in addition, protective layer (10) is made of magnesium oxide including silicon of $5\times10^{18}$ atoms/cm$^3$ to $2\times10^{21}$ atoms/cm$^3$ and carbon of $1\times10^{18}$ atoms/cm$^3$ to $2\times10^{21}$ atoms/cm$^3$.

10 Claims, 3 Drawing Sheets

U.S. PATENT DOCUMENTS

| | | | | |
|---|---|---|---|---|
| 6,657,396 | B2 * | 12/2003 | Nakada et al. | 313/584 |
| 2004/0027072 | A1 * | 2/2004 | Inoue et al. | 313/582 |
| 2006/0055324 | A1 * | 3/2006 | Hasegawa et al. | 313/587 |
| 2006/0145614 | A1 * | 7/2006 | Choi et al. | 313/582 |

FOREIGN PATENT DOCUMENTS

| | | |
|---|---|---|
| JP | 2001-110321 A | 4/2001 |
| JP | 2004-71338 | 3/2004 |

* cited by examiner

PLASMA DISPLAY PANEL, ITS MANUFACTURING METHOD, AND ITS PROTECTIVE LAYER MATERIAL

TECHNICAL FIELD

The present invention relates to a plasma display panel (hereinafter, abbreviated as "PDP") used for an image display apparatus for example and its manufacturing method, and to a material for its protective layer.

BACKGROUND ART

An AC surface-discharge-type PDP is composed of a front substrate, formed with a plurality of display electrodes including scanning electrodes and sustain electrodes; and a back substrate, formed with a plurality of address electrodes orthogonal to the display electrodes. The front and back substrates are arranged facing each other so that they form a discharge space therebetween, their peripheries are sealed, and a discharge gas such as neon, xenon, or the like is encapsulated in the discharge space. The display electrode is covered with a dielectric layer, forming a protective layer thereon. The protective layer is generally formed with a material with a high anti-sputtering property such as magnesium oxide (MgO), protecting the dielectric layer from ion bombardment caused by discharge. In addition, each display electrode composes one line, forming a discharge cell where it crosses an address electrode.

In such a PDP, one field (1/60 second) for an image signal is composed of a plurality of subfields, each having a luminance weight. Each subfield has an address period, during which data is written by write discharge in a discharge cell to be lighted with each line scanned sequentially; and a sustain period, during which the discharge cell is lighted by discharge for the number of times corresponding to the luminance weight, in discharge cells where data has been written in the address period.

For displaying a television image, all the actions for each subfield must be completed within one field. Therefore, write discharge in each line needs to be completed in a shorter time as the number of lines (scan lines) increases with moving to finer-resolution of discharge cells. In other words, high-speed drive is required in an address period by narrowing the width of pulses applied to a scanning electrode and address electrode for generating write discharge. However, due to "discharge delay," which means discharge occurs a certain time delayed after a pulse rises, the discharge completes while pulses are applied with a low probability, for the above-mentioned high-speed drive. Consequently, writing data to a discharge cell to be lighted sometimes fails, causing a lighting defect to lose display quality.

As the main factor that causes the above-mentioned discharge delay, primary electrons to trigger discharge are presumably becoming hard to be emitted into the discharge space from the protective layer. Therefore, display quality is expected to be improved by examining the protective layer.

In order to improve the behavior of such electron emission from a protective layer, a case is disclosed, for example, in the patent gazette (Publication No. 10-334809), where secondary electrons emit more increasingly by including silicon (Si) in a protective layer made of MgO, raising the display quality.

Meanwhile, if Si is included in a protective layer made of MgO, the capacity of electron emission largely fluctuates according to the temperature of the protective layer, and so does the discharge delay time. Consequently, the quality of image display changes according to the environmental temperature when a PDP is practically used.

In order to solve such a problem, the present invention aims at implementing a high-speed response for generating discharge to an applied voltage by shortening the discharge delay time, as well as at suppressing the change in the discharge delay time according to temperature.

SUMMERY OF THE INVENTION

In order to achieve the above-mentioned purpose, the present invention provides a PDP in which a dielectric layer is formed so as to cover a scanning electrode and sustain electrode formed on a substrate, and a protective layer is formed on the dielectric layer, characterized that the protective layer includes carbon (C) and silicon (Si).

Such a makeup provides a PDP that implements high-speed response with a short discharge delay time, and high-quality image display.

DETAILED DESCRIPTION OF PREFERRED EMBODIMENTS

Hereinafter, embodiments of the present invention are described using drawings.

The First Embodiment

Figure 1:
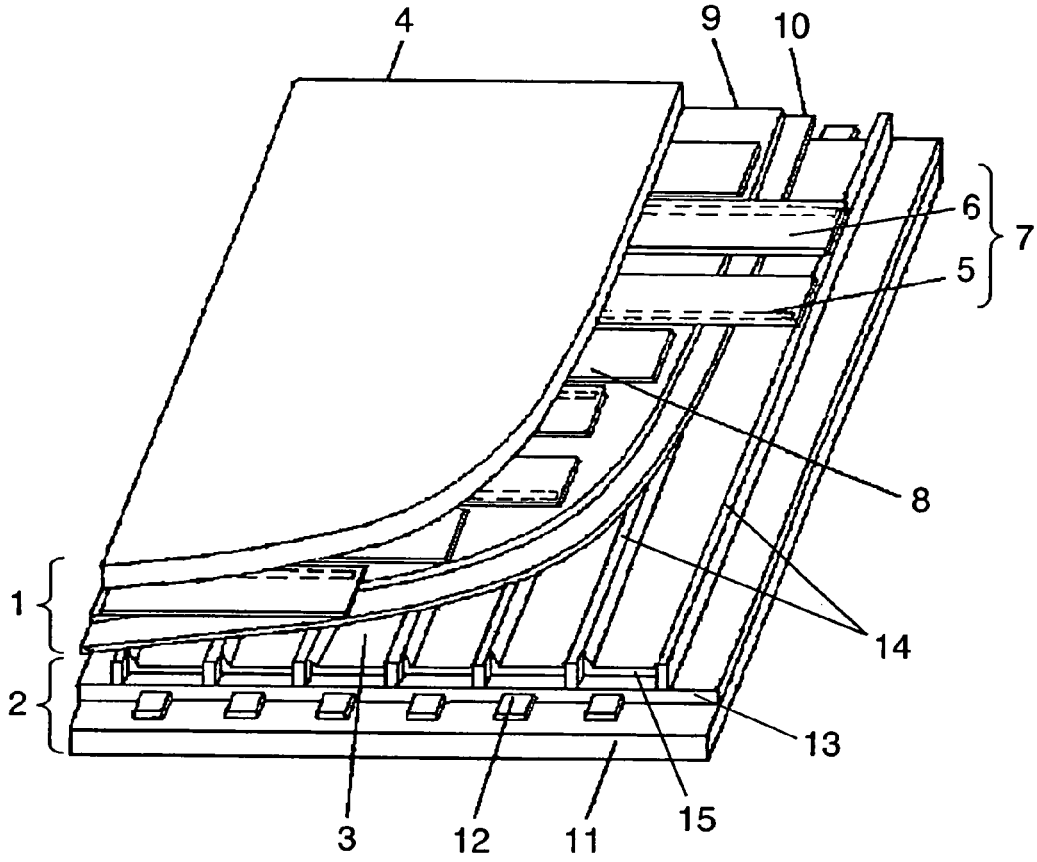
FIG. 1 is a perspective view showing a part of a PDP according to the first embodiment of the present invention.

FIG. 1 is a perspective view showing an AC surface-discharge-type PDP partially cut away, according to the first embodiment of the present invention. In this PDP, front panel 1 and back panel 2 are arranged facing each other, discharge space 3 is formed therebetween, and a discharge gas made of neon, xenon, or the like, is encapsulated in discharge space 3.

Front panel 1 has the following makeup. That is, a plurality of display electrodes 7 are formed including stripe-like scanning electrode 5 and stripe-like sustain electrode 6 on front substrate 4, made of glass, and light-impervious layer 8 is formed between adjacent display electrodes 7. Further, dielectric layer 9 is formed so as to cover display electrode 7 and light-impervious layer 8, and protective layer 10 made of magnesium oxide (MgO) including carbon (C) and silicon (Si) is formed on dielectric layer 9 so as to cover its surface.

Back panel 2 has the following makeup. That is, a plurality of stripe-like address electrodes 12 are formed so as to be orthogonal to scanning electrode 5 and sustain electrode 6 on back substrate 11, made of glass, and electrode protective layer 13 is formed so as to cover address electrode 12. Further, rib 14 parallel with address electrode 12 is provided on this electrode protective layer 13, and also between address electrodes 12; and phosphor layer 15 is formed between ribs 14. Electrode protective layer 13 protects address electrode 12 and reflects visible lights generated by phosphor layer 15 to front panel 1.

Each display electrode 7 composes one line, and a discharge cell is formed where display electrode 7 and address electrode 12 cross each other. Display is performed in the following way. That is, discharge is generated in discharge space 3 of each discharge cell, and three-color visible lights (red, green, and blue) generated by phosphor layer 15 according to discharge, transmit through front panel 1.

Figure 2:
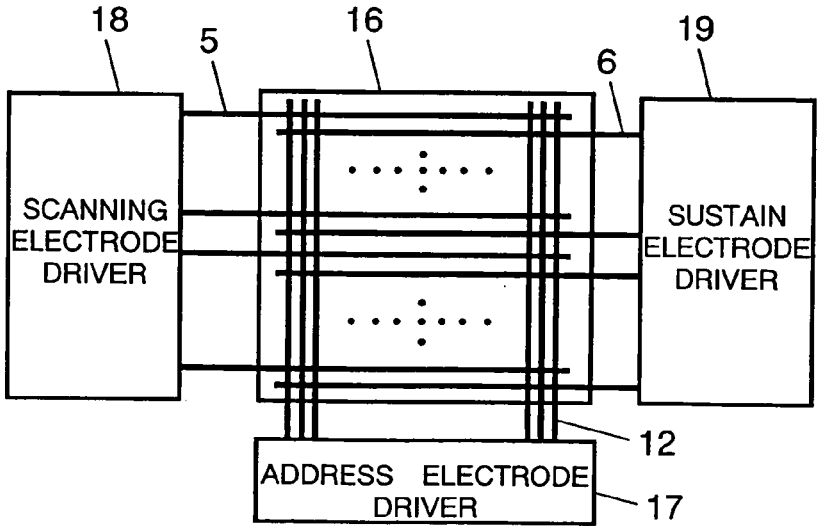
FIG. 2 is a block diagram showing an example of an image display apparatus with the PDP used.

FIG. 2 is a block diagram showing an example of an image display apparatus using the PDP shown in FIG. 1. As shown in FIG. 2, address electrode driver 17 is connected to address electrode 12 of PDP 16; scanning electrode driver 18, to scanning electrode 5 of PDP 16; and sustain electrode 6 of PDP 16, to sustain electrode driver 19.

Figure 3:
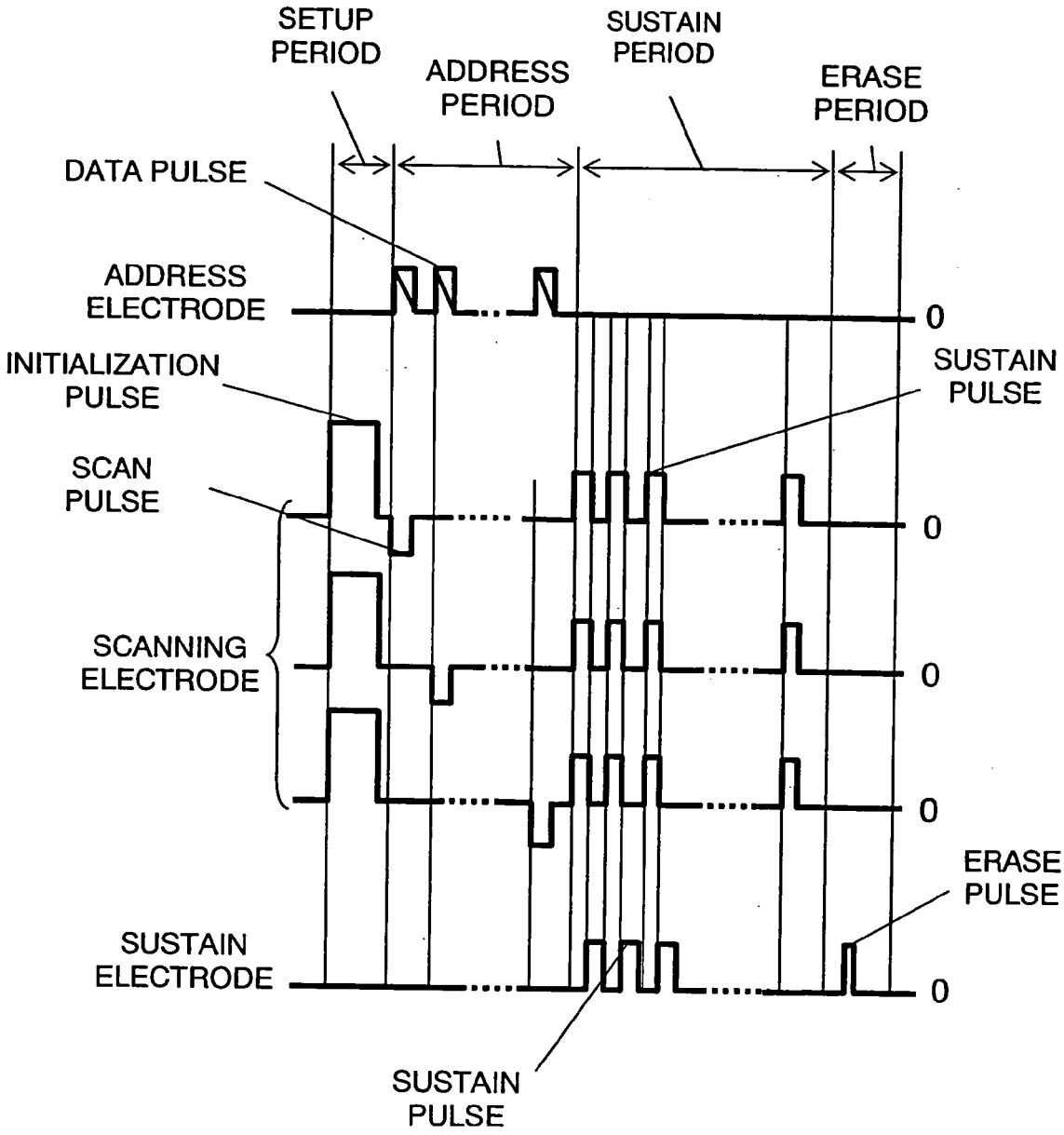
FIG. 3 is a time chart showing driving waveforms of the PDP.

FIG. 3 is a time chart showing driving waveforms of the PDP. Generally, an AC surface-discharge-type PDP uses a method in which gradation is represented by dividing an image of one field into a plurality of subfields. In this method, in order to control discharge in each discharge cell, one subfield is composed of four periods: setup period, address period, sustain period, and erase period. FIG. 3 is a time chart showing driving waveforms in one subfield.

In FIG. 3, in a setup period, in order to facilitate discharge, wall charge is uniformly accumulated in all the discharge cells in the PDP. In an address period, write discharge is performed for discharge cells to be lighted. In a sustain period, discharge cells where writing has been performed in the address period are lighted, and the lighting is sustained. In an erase period, lighting of discharge cells are stopped by extinguishing wall charge.

In a setup period, an initialization pulse is applied to scanning electrode 5 to apply a voltage higher than that on address electrode 12 and sustain electrode 6, to scanning electrode 5, generating discharge in the discharge cells. The charge generated by the discharge is accumulated on the wall surface of discharge cells so as to cancel the potential difference between address electrode 12, scanning electrode 5, and sustain electrode 6. Consequently, on the surface of protective layer 10 near scanning electrode 5, negative charge is accumulated as wall charge. Also, on the surface of phosphor layer 15 near address electrode 12, and on the surface of protective layer 10 near sustain electrode 6, positive charge is accumulated as wall charge. This wall charge causes wall potential with a predetermined value between scanning electrode 5 and address electrode 12, and scanning electrode 5 and sustain electrode 6.

In an address period, when lighting discharge cells, scanning pulses are applied to scanning electrode 5, and data pulses are applied to address electrode 12, where a voltage lower than those for address electrode 12 and sustain electrode 6 is applied to scanning electrode 5. In other words, a voltage is applied between scanning electrode 5 and address electrode 12, in the same direction as the wall potential, and so is between scanning electrode 5 and sustain electrode 6, for generating write discharge. Consequently, negative charge is accumulated on the surface of phosphor layer 15 and on the surface of protective layer 10 near sustain electrode 6; and positive charge is accumulated on the surface of protective layer 10 near scanning electrode 5 as wall charge. This causes wall potential with a predetermined value between sustain electrode 6 and scanning electrode 5.

In a sustain period, at first, sustain pulses are applied to scanning electrode 5 to apply a voltage higher than that for sustain electrode 6, to scanning electrode 5. In other words, a voltage is applied between sustain electrode 6 and scanning electrode 5 in the same direction as the wall potential to generate sustain discharge. Consequently, lighting discharge cells can be started. Next, sustain pulses are applied so that the polarity between sustain electrode 6 and scanning electrode 5 switches alternately, enabling intermittent pulse light emission.

In an erase period, erasing pulses with a narrow width are applied to sustain electrode 6 to generate incomplete discharge, extinguishing wall charge, and thus erasing is performed.

Here, in an address period, discharge delay is the time from when a voltage is applied for generating write discharge between scanning electrode 5 and address electrode 12, until when write discharge occurs. This discharge delay causes write failure if write discharge does not occur while a voltage is applied for performing write discharge between scanning electrode 5 and address electrode 12 (address time), and thus sustain discharge does not occur, showing flicker in the display image. As further finer resolution is achieved, the address time allocated to each scanning electrode becomes shorter, causing a higher probability of write failure.

A PDP according to the first embodiment of the present invention features a material composing protective layer 10. Next, a description is made for the content with a case where a protective layer is formed using vacuum evaporation method.

An apparatus used for vacuum evaporation method to form protective layer 10 mentioned above is generally composed of a preparation chamber, heating chamber, deposition chamber, and cooling chamber; and the substrate is conveyed in this order to form a protective layer made of magnesium oxide (MgO) with deposition. In this case, in the embodiment of the present invention, a deposition material made of MgO including C and Si that is to become a deposition source is heated and vaporized in an oxygen ambience using a piercing-type electron beam gun, to form protective layer 10 with film-forming process, which accumulates the material on the substrate. At this moment, some conditions in film-forming process is arbitrarily defined such as electron beam current amount, oxygen partial pressure amount, and substrate temperature. The followings show an example of set condition for forming a film.

Ultimate vacuum: $5.0\times10^{-4}$ Pa or less

Temperature on substrate when depositing: 200° C. or higher

Pressure when depositing: $3.0\times10^{-2}$ Pa to $8.0\times10^{-2}$ Pa

Here, as a material for a protective layer, a deposition material is used that is a mixture of a sintered body from MgO, and powders of Si and C. In this case, some kinds of deposition materials are used that are powders of Si and C with different densities respectively. Then some kinds of substrates with protective layer 10 deposited are made using these deposition materials to produce respective PDPs from these substrates.

In addition, protective layer 10 of each PDP is analyzed with secondary ion mass spectrometry (SIMS) to obtain the densities of C and Si contained in protective layer 10. In this case, the densities of C and Si contained in protective layer 10 obtained with SIMS are converted to the numbers of atoms per unit volume, by using an MgO film that Si or C is injected with ion film implantation therein as a standard sample.

Next, in an environment of the ambient temperature of −5° C. to 80° C., the discharge delay times of each PDP are measured, Arrhenius plot for the discharge delay times to temperature is created from the measurement results, and the activation energy values for the discharge delay times to the densities of Si and C in protective layer 10 are obtained from the approximated straight line.

Here, the discharge delay time is, in an address period, the time from when a voltage is applied between scanning electrode 5 and address electrode 12, until when discharge (write discharge) occurs. The discharge delay times are measured as follows: observe each PDP with write discharge being generated, define the time when the intensity of light-emitting by the write discharge reaches its peak, as the time when discharge occurs, and then average the discharge delay times for a hundred times of light-emitting caused by the write discharge.

The activation energy value is a numeric value representing the change in characteristic (discharge delay time, in this embodiment) to temperature. The lower the activation energy value is, the less the characteristic changes to temperature.

As a result obtained in the above-mentioned way, the activation energy values to the densities of Si and C contained in protective layer 10 are shown in Table 1.

| | | Density of Si $\times 10^{18}$ (atoms/cm$^3$) | | | | | | | | |
|---|---|---|---|---|---|---|---|---|---|---|
| | | 5 | 50 | 100 | 200 | 700 | 1,000 | 2,000 | 7,000 | 12,000 |
| Density of C $\times 10^{18}$ (atoms/cm$^3$) | 1 | 0.98 | 1.02 | 1.00 | 1.10 | 0.98 | 1.05 | 1.03 | 1.02 | 1.00 |
| | 10 | 0.56 | 0.96 | 0.86 | 0.89 | 1.07 | 1.02 | 0.92 | 0.98 | 1.06 |
| | 50 | 0.46 | 0.68 | 0.78 | 0.92 | 1.03 | 1.03 | 0.87 | 0.99 | 0.93 |
| | 100 | 0.42 | 0.44 | 0.65 | 0.87 | 0.99 | 1.09 | 0.86 | 1.07 | 1.04 |
| | 400 | 0.37 | 0.39 | 0.43 | 0.57 | 0.88 | 0.92 | 1.02 | 1.05 | 1.03 |
| | 700 | 0.43 | 0.37 | 0.45 | 0.45 | 0.77 | 0.83 | 0.86 | 0.98 | 1.12 |
| | 1,000 | 0.44 | 0.44 | 0.44 | 0.46 | 0.65 | 0.59 | 0.88 | 1.08 | 1.18 |
| | 2,000 | 0.42 | 0.42 | 0.43 | 0.38 | 0.54 | 0.66 | 0.67 | 0.87 | 0.96 |

In the conventional example, the PDP has protective layer 10 deposited with a deposition material with only Si of 300 ppm by weight added to an MgO-sintered body. The analysis of protective layer 10 of the PDP in this conventional example, with SIMS shows that the protective layer includes approximately $1\times10^{20}$ atoms/cm$^3$ of Si. Table 1, defining the activation energy value for the discharge delay time in the PDP in the conventional example, as 1, shows the activation energy value for the discharge delay time in each PDP, in relative values. Still, the activation energy value in a case where a deposition material with only Si added to an MgO-sintered body, is roughly constant independently of the density of Si added.

In Table 1, for the PDPs with Si density of $7\times10^{21}$ atoms/cm$^3$ and $1.2\times10^{22}$ atoms/cm$^3$, the discharge delay time is too long, or the voltage required to generating discharge is unusually high, and thus image display fails with the conventional set voltage value. Accordingly, the Si density of protective layer 10 is desirably $5\times10^{18}$ atoms/cm$^3$ to $2\times10^{21}$ atoms/cm$^3$. In addition, a large C density of protective layer 10 shows a tendency of small activation energy value. If Si density is low, even if C density is low, the activation energy is considerably small, while in order to considerably lower the activation energy for a high Si density, C density needs to be high to some extent. In order to considerably lower the activation energy as mentioned above, C density is desirably increased according to a high Si density of the protective layer. Particularly, as shown by the underlined figures in Table 1, in a range where C density/Si density$\geqq$1, namely in a case where the number of C atoms in protective layer 10 exceeds that of Si, activation energy is found to be considerably small.

Therefore, including Si and C in protective layer 10 of the PDP enables the discharge delay time to be shorter, and also the change in discharge delay time to temperature to be suppressed. From these results, the desirable density range is: Si density, $5\times10^{18}$ atoms/cm$^3$ to $2\times10^{21}$ atoms/cm$^3$; C density, $1\times10^{18}$ atoms/cm$^3$ to $2\times10^{21}$ atoms/cm$^3$. Further, a PDP having protective layer 10 satisfying the condition: C density/Si density$\geqq$1, enables the activation energy to be considerably small, effectively suppressing the change in discharge delay time to temperature.

In addition, if a position with the above-mentioned density range exists in a part between the most outer surface of protective layer 10, and a depth of 200 nm in the film thickness direction, the above-mentioned effect is proved to be achieved.

Meanwhile, in order to produce protective layer 10 having the above-mentioned density ranges for Si and C, respective powders of Si and C need to be added in the deposition material, where they may be elementary substances of C or Si, or compounds of C and Si respectively. Such compounds include $SiO_2$, $Al_4C_3$, and $B_4C$. The amount added to the deposition material for the deposition source varies depending on a deposition condition, and thus it is required to be defined by analysis with SIMS after forming the film. Table 2 shows the density of Si added to the deposition source used in this embodiment, and the number of Si atoms in protective layer 10. Table 3 shows the density of C added to the deposition source used in this embodiment, and the number of C atoms in protective layer 10.

TABLE 2

| | | | | |
|---|---|---|---|---|
| Density of Si in protective layer (atoms/cm$^3$) | | $5.0\times10^{18}$ | to | $2.0\times10^{21}$ |
| Density of powder added to deposition source (ppm by weight) | Si powder | 7 | to | 8,000 |
| | $SiO_2$ powder | 14 | to | 17,200 |

TABLE 3

| | | | | |
|---|---|---|---|---|
| Density of C in protective layer (atoms/cm$^3$) | | $1.0\times10^{18}$ | to | $2.0\times10^{21}$ |
| Density of powder added to deposition source (ppm by weight) | C powder | 5 | to | 1,500 |
| | $Al_4C_3$ powder | 19 | to | 6,000 |
| | $B_4C$ powder | 22 | to | 7,000 |

In this embodiment, as shown in Table 2, if the densities of powder added to the deposition source are defined as: for Si powder, 7 ppm to 8,000 ppm by weight; for $SiO_2$ powder, 14 ppm to 17,200 ppm by weight, Si density of the protective layer can be determined to roughly $5\times10^{18}$ atoms/cm$^3$ to $2\times10^{21}$ atoms/cm$^3$. In addition, as shown in Table 3, if the densities of powder added to the deposition source are defined as: for C powder, 5 ppm to 1,500 ppm by weight; for $Al_4C_3$ powder, 19 ppm to 6,000 ppm by weight; for $B_4C$ powder, 22 ppm to 7,000 ppm by weight, C density of protective layer 10 can be determined to roughly $1\times10^{18}$ atoms/cm$^3$ to $2\times10^{21}$ atoms/cm$^3$. In this case, the deposition source with $SiO_2$ powder of 14 ppm to 17,200 ppm by weight added includes Si of roughly 7 ppm to 8,000 ppm by weight. Also, the deposition source with $Al_4C_3$ powder of 19 ppm to 6,000 ppm by weight added includes C of roughly 5 ppm to 1,500 ppm by weight; the deposition source with $B_4C$ powder of 22 ppm to 7,000 ppm by weight added, C of roughly 5 ppm to 1,500 ppm by weight.

The Second Embodiment

Methods of producing a deposition material for a deposition source include a method where the above-mentioned powder is mixed into a crystalline body or sintered body of MgO, and a method where the powder listed in Table 2 or Table 3 is mixed into MgO powder for the base material, and then its sintered body is produced.

The first embodiment describes a case where respective Si and C powders are added to the deposition source. Instead, a deposition source with silicon carbide (SiC) added may be used. When SiC is added, unlike in the first embodiment, the Si and C densities of protective layer 10 can not be controlled independently; however, a protective layer including Si and C can be obtained.

Here in this embodiment, protective layer 10 is formed using a deposition source with an MgO sintered body and SiC powder mixed as a material of protective layer, to produce a PDP having this protective layer 10. Next, the activation energy for the discharge delay time of each PDP is obtained similarly to the first embodiment. The result is shown in FIG. 4, where, in the same way as in the first embodiment, the conventional example is a case where only Si of 300 ppm by weight is added to MgO, and this activation energy value is 1.

Figure 4:
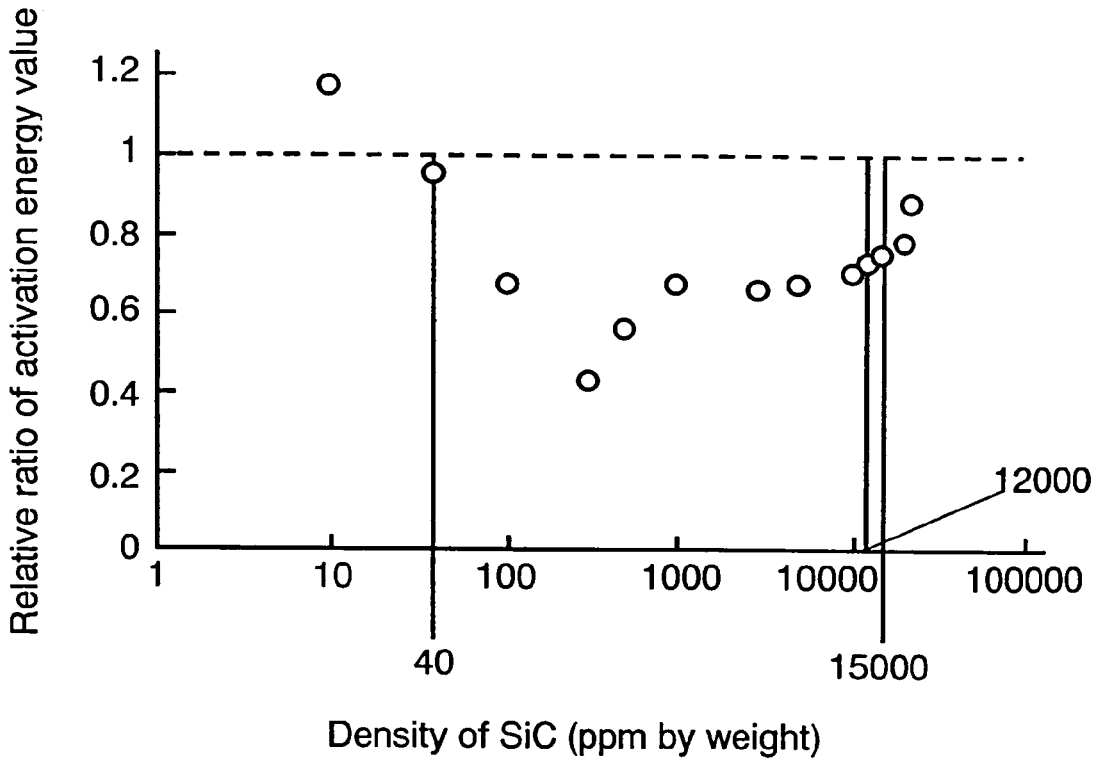
FIG. 4 is a characteristic diagram showing activation energy values of a PDP according to the second embodiment of the present invention.

As shown in FIG. 4, if the density of SiC added to the deposition source is more than 40 ppm by weight, the value of activation energy decreases, as compared to the conventional example, where only Si is added. However, if the density is more than 15,000 ppm by weight, the discharge delay time is long, or a voltage required to discharge is unusually high, and consequently image display fails at the conventional set voltage values. In other words, a PDP having a protective layer formed using an MgO deposition source with its SiC density of 40 ppm to 12,000 ppm by weight, can display image without changing the conventional set voltage values, has a high capacity of electron emission, and suppresses the dependence of discharge delay time on temperature. Still, in protective layer 10 formed using an MgO deposition source with its SiC density of 40 ppm to 12,000 ppm by weight, its Si density is roughly $5\times10^{18}$ atoms/cm$^3$ to $2\times10^{21}$ atoms/cm$^3$; its C density, roughly $1\times10^{18}$ atoms/cm$^3$ to $1\times10^{21}$ atoms/cm$^3$.

As described above, including Si and C in protective layer 10 of a PDP enables the discharge delay time to be shortened, and also the dependence of discharge delay time on temperature to be suppressed. In addition, a PDP having protective layer 10, made of MgO, including Si of $5\times10^{18}$ atoms/cm$^3$ to $2\times10^{21}$ atoms/cm$^3$; C, $1\times10^{18}$ atoms/cm$^3$ to $2\times10^{21}$ atoms/cm$^3$, can display image without changing conventional set voltage values, and can suppress dependence of the discharge delay time on temperature. Further, in a PDP having protective layer 10 where the number of C atoms is larger than that of Si, decreasing the activation energy enables the dependence of the discharge delay time on temperature to be effectively suppressed.

These phenomena, although uncertain, seem to result from the following presumption. That is, adding Si and C, not Si only, to MgO excludes the factor making the temperature characteristic prominent. In addition, the protective layer according to the embodiment of the present invention forms an impurity level between the valence band and conduction band, has a high capacity of electron emission, and thus a short discharge delay time, representing a fast response of discharge generation to voltage application. This provides a favorable image display without flicker.

For a method of manufacturing the above-mentioned protective layer, deposition method is described. However, besides deposition method, sputtering, ion-plating method, or the like is also available, as long as the components for the target material and raw material are properly controlled and the film is formed with the above-mentioned materials.

In addition, other than using a material for a protective layer whose components have been controlled in advance, the elements may be added while the film for a protective layer is being formed. For example, when forming the film for a protective layer with deposition method, a gas including Si and C as an ambient gas may be used.

Further, after a protective layer is film-formed, C and Si elements may be added to the protective layer, where its method includes ion implantation. In this case, first, MgO film with high purity is formed, and then implant ions of C and Si elements. Ion implantation enables forming a protective layer including C and Si elements with their densities accurately prescribed. The following shows an example for set conditions in ion implantation.

Dose amount: $10^{11}$/cm$^2$ to $10^{16}$/cm$^2$

Accelerating voltage: 10 KeV to 150 KeV

Still, other methods where elements are added after film-forming a protective layer may be adopted such as plasma doping method performed in a gas atmosphere including C and Si; and a method where after film-forming high-purity MgO, Si and C are film-formed, and then thermal diffusion is performed.

INDUSTRIAL APPLICABILITY

As described hereinbefore, the present invention provides a plasma display panel that has a fast response for discharge generation to voltage application, with a short discharge delay time, and also suppresses the change in the discharge delay time to temperature, offering favorable image display.

The invention claimed is:

1. A plasma display panel in which a dielectric layer is formed so that the dielectric layer covers a scanning electrode and a sustain electrode formed on a substrate, and in which a protective layer is formed on the dielectric layer, wherein the protective layer is made of magnesium oxide including carbon and silicon.

2. A plasma display panel as claimed in claim 1, wherein a protective layer is made of magnesium oxide including silicon with $5\times10^{18}$ atoms/cm$^3$ to $2\times10^{21}$ atoms/cm$^3$, and carbon with $1\times10^{18}$ atoms/cm$^3$ to $2\times10^{21}$ atoms/cm$^3$.

3. A plasma display panel as claimed in claim 2, wherein the number of carbon atoms is greater than that of silicon.

4. A method of manufacturing a plasma display panel in which a dielectric layer is formed so that the dielectric layer covers a scanning electrode and a sustain electrode formed on a substrate, and in which a protective layer made of magnesium oxide including carbon and silicon is formed on the dielectric layer, wherein a process for forming the protective layer is a process using a material for a protective layer, including carbon, and silicon and magnesium oxide.

5. A method of manufacturing a plasma display panel as claimed in claim 4, wherein the material for a protective layer includes the density of carbon ranges from 5 ppm to 1,500 ppm by weight, and the density of silicon ranges from 7 ppm to 8,000 ppm by weight.

6. A method of manufacturing a plasma display panel as claimed in claim 4, wherein the material for a protective layer includes magnesium oxide and silicon carbide; and wherein the density of silicon carbide ranges from 40 ppm to 12,000 ppm by weight.

7. A method of manufacturing a plasma display panel in which a dielectric layer is formed so that the dielectric layer covers a scanning electrode and a sustain electrode formed on a substrate, and in which a protective layer made of magnesium oxide including carbon and silicon is formed on the dielectric layer, wherein carbon and silicon are added in the protective layer after the protective layer is formed by forming magnesium oxide on the dielectric layer.

8. A material for a protective layer of a plasma display panel in which a dielectric layer is formed so that the dielectric layer covers a scanning electrode and a sustain electrode formed on a substrate, and in which a protective layer made of magnesium oxide including silicon and carbon is formed on the dielectric layer, wherein the material for a protective layer includes carbon, silicon and magnesium oxide.

9. A material for a protective layer of a plasma display panel as claimed in claim 8, wherein the material for a protective layer includes the density of the carbon ranges from 5 ppm to 1,500 ppm by weight, and the density of the silicon ranges from 7 ppm to 8,000 ppm by weight.

10. A material for a protective layer of a plasma display panel as claimed in claim 8, wherein the material for a protective layer includes magnesium oxide and silicon carbide; and wherein the density of the silicon carbide ranges from 40 ppm to 12,000 ppm by weight.

* * * * *